United States Patent [19]

Chang

[11] Patent Number: 4,710,049

[45] Date of Patent: Dec. 1, 1987

[54] SAFETY HINGE

[75] Inventor: Chang Chang, Monterey Park, Calif.

[73] Assignee: Virco Mfg. Corporation, Los Angeles, Calif.

[21] Appl. No.: 9,517

[22] Filed: Jan. 30, 1987

[51] Int. Cl.[4] ..... F16B 11/00

[52] U.S. Cl. ..... 403/23; 403/286; 5/99 C; 5/424; 256/25; 16/250

[58] Field of Search ..... 5/99 C, 424, 425, 427; 256/25, 26, 1; 403/23, 286, 53; 16/250, 251

[56] References Cited

U.S. PATENT DOCUMENTS

| | | | |
|---|---|---|---|
| 3,596,906 | 8/1971 | Parmer | 403/23 X |
| 4,523,745 | 6/1985 | Killman et al. | 256/1 |
| 4,573,224 | 3/1986 | Saint | 5/99 C |

*Primary Examiner*—Andrew V. Kundrat
*Attorney, Agent, or Firm*—James E. Brunton

[57] ABSTRACT

A padded safety hinge construction for use in infant playyards and the like wherein the fasteners which hold the padding of the hinge in place also function as the pivot pins about which the playyard legs pivot. The inwardly protruding extremities of the hinge mechanism and the connecting fasteners are completely covered with padding so that an infant within the interior of the playyard enclosure is safeguarded from contacting any part of the mechanical structure. Should the infant fall against the hinge assembly it will only contact the smooth, padded covering which fully encapsulates the hinge mechanism.

6 Claims, 3 Drawing Figures

SAFETY HINGE

BACKGROUND OF THE INVENTION

1. Field of the Invention

The present invention relates generally to infant furniture. More particularly the invention concerns a padded hinge assembly for use in connection with foldable infant playyards.

2. Discussion of the Prior Art

In recent years, the public, as well as manufacturers of childrens furniture, have become acutely aware of the dangers presented by prior art furniture of the character adapted for use by infants and small children. Particularly dangerous is folding furniture which, of necessity, embodies hinge assemblies and like mechanical constructions for permitting pivotal movement of the component parts of the furniture. For example, in foldable playyards, to which the present invention is specifically directed, potentially dangerous hinge assemblies are used to permit folded of the supporting legs and the top rails of the unit from an erected configuration into a folded, transport configuration. To prevent injury to the infant placed in the playyard, these hinges are generally covered with a fabric or padding of some type which is held in place by fasteners the extremities of which protrude into the confines of the playyard. These fasteners have proven to be hazardous in that teething infants will frequently place their mouths over the ends of the fasteners. The infant then loses its balance and, upon falling, may break its teeth or cut its mouth or lips. Additionally, the ends of the fasteners can cause potentially serious bruises and cuts if the infant falls against the sides of the playyard.

It is the drawbacks of the prior art playyard designs of the character described in the preceding paragraphs which the present invention seeks to avoid. These drawbacks are uniquely overcome by providing a padded safety hinge arrangement in which inwardly protruding fasteners are completely covered by a padded covering. More particularly, the hinge construction of the present invention wherein the fasteners hold the padding in place and also function as the pivot pins about which the playyard legs pivot, the inwardly protruding extremities of the fasteners are completely covered. With this construction, an infant within the interior of the playyard enclosure is safeguarded from contacting the fasteners and should the infant fall against the hinge assembly it will only contact the smooth, padded covering which fully encapsulates the fasteners.

SUMMARY OF THE INVENTION

It is an object of the present invention to provide a safety hinge assembly for uses in structures such as infant furniture in which the portions of the hinge accessible to the infant are completely covered to prevent contact by the infant with the structural component of the hinge assembly.

It is another object of the invention to provide a safety hinge assembly of the aforementioned character in which the hinge covering embodies a padding material which acts as a shock absorber to prevent injury to the infant should it fall against the hinge assembly.

Another object of the invention is to provide a safety hinge assembly as described in the preceding paragraphs in which the hinge covering in no way adversely effect the mechanical operation of the assembly.

Still another object of the invention is to provide a safety assembly of the class described which is easy to clean, inexpensive to manufacture and simple to install.

These and other objects of the invention are realized by a safety hinge comprising a rigid bracket having transversely spaced inner and outer side walls each of which is provided with longitudinally spaced apertures therethrough, the upper extremities of the foldable legs of the playyard being closely receivable between the side walls of the bracket. A planar member is disposed proximate the inner side wall of the bracket and has longitudinally spaced apertures indexable with the apertures in the inner side wall of the bracket. Enclosing the planar member and the bracket is a foldable enclosure pad which includes a first portion receivable between the planar member and the inner side wall of the bracket and a second hollow portion containing foam padding which is connected to the first portion and has an edge portion provided with longitudinally spaced apertures indexable with the apertures in the outer side wall of the bracket. A pair of connector pins having first and second extremities are closely receivable through the apertures provided in the planar member, the first portion of the foldable enclosure, the inner side wall of the bracket, the legs of the playyard, the outer side wall of the bracket and the second hollow portion of the foldable enclosure. The first, or inner, extremities of the connector pins are disposed intermediate the planar member and the foldable enclosure when the latter means is folded over the planar member. Rounded caps receivable over the second, or outside, extremities of the connector pins engage the foldable enclosure to hold the enclosure in position over the planar member and the bracket.

DESCRIPTION OF THE INVENTION

Figure 1:
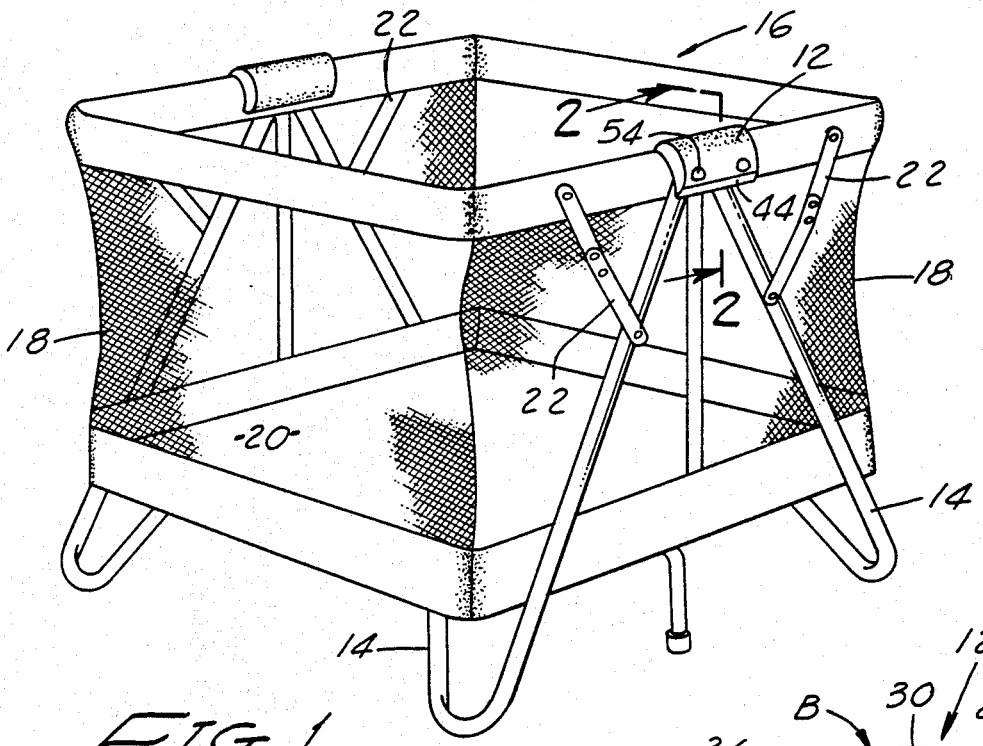
FIG. 1 is a generally perspective view of a playyard embodying the safety hinge assembly of the present invention.

Referring to the drawings, and particularly to FIG. 1, the safety hinge of the present invention is generally designated by the numeral 12. In this instance the safety hinge 12 is embodied in a foldable infant playyard of the character shown in FIG. 1 having angularly downwardly depending, hair pin like supporting legs 14. Legs 14 are pivotally movable from a first operating position as shown in FIG. 1, wherein the lower extremities are spaced apart, to a second folded position, wherein the lower extremities of the legs 14 are moved into close proximity. Playyards of the character in which the safety hinge of the present invention may be used also typically include a circumferentially extending, two piece top rail 16 which is also foldable from the configuration shown in FIG. 1 into a collapsed configuration wherein the top rail pieces are disposed adjacent the supporting legs 14. In the erect configuration, top rail 16 supports downwardly depending mesh side walls 18 which are connected to a split floor arrangement 20. Floor 20 is also foldable from the configuration shown in FIG. 1 into a folded configuration in which the playyard may be conveniently transported or stored. Transversely spaced hinge assemblies 22 are provided at either end of the playyard and function to hingably interconnect the top rail portions with the supporting legs 14.

Figure 2:
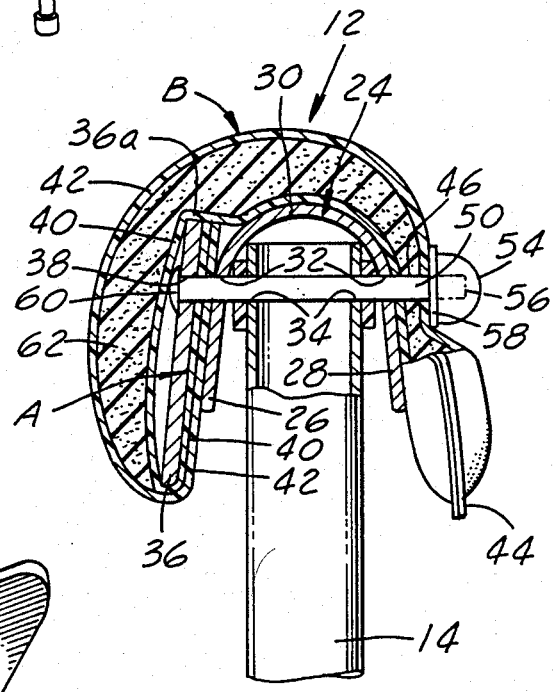
FIG. 2 is a greatly enlarged fragmentary crosssectional view taken along lines 2—2 of FIG. 1.
Figure 3:
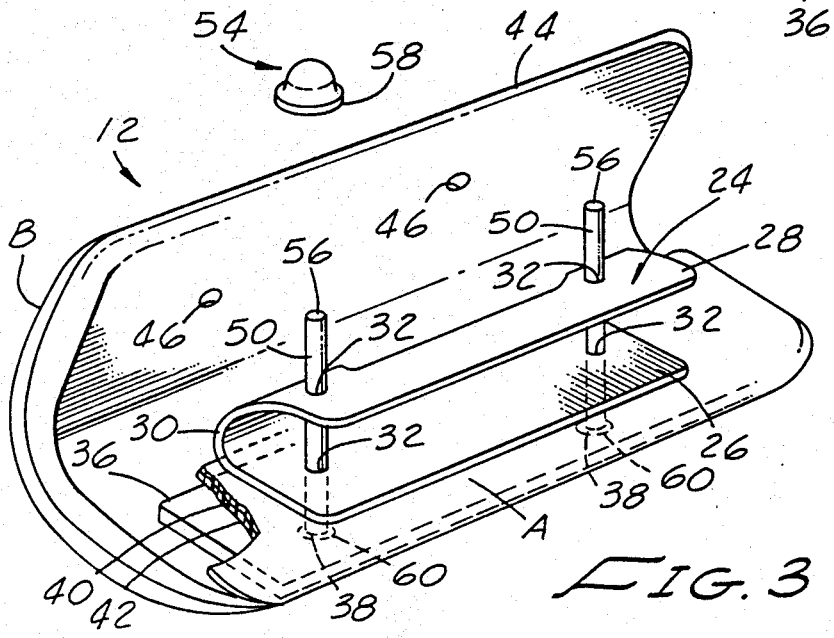
FIG. 3 is a generally perspective view of the safety hinge assembly in a partially unfolded configuration.

Turning now to FIGS. 2 and 3, the safety hinge means of the present invention can be seen to comprise a rigid, generally "U" shaped bracket 24 which includes spaced apart inner and outer side walls 26 and 28. Side walls 26 and 28 are interconnected by a bight portion 30 and each of the side walls is provided with longitudinally spaced apart apertures 32 (FIG. 3). As best seen in FIG. 2, the upper extremities of legs 14 are closely receivable between the side walls of the bracket 24 in a manner such that apertures 34 provided in the upper extremities of each of the leg members are indexable with the apertures 32 in the side walls of bracket 24.

Also forming a part of the safety hinge means of the present invention is an elongated planar member 36 which is disposed proximate the inner side wall 26 of bracket 24. Planar member 36 is also provided with longitudinally spaced apertures 38 (FIG. 2) which are indexable with the apertures 32 provided through the inner side wall 26 of the bracket 24.

Forming an important aspect of the safety hinge means of the present invention is enclosure means for enclosing planar member 36 and bracket 24. In the embodiment of the invention shown in the drawings, the enclosure means is provided in the form of a pair of substantially rectangularly shaped thin sheets 40 and 42 of flexible material having aligned outer, side and end margins. Preferably these thin sheets of flexible thin sheets of flexible material are formed from a vinyl plastic so that the sheets can be interconnected along their margins by a heat sealing process.

Sheets 40 and 42 have first portions "A" receivable between planar member 36 and first wall 26 of bracket 24 (FIG. 3). First portions "A" are interconnected, or integral with, a second hollow portion "B" which terminates in a edge portion 44. As shown in FIGS. 1 and 2, when the hinge means is fully assembled, edge portion 44 extends downwardly on the outside of the playyard assembly. As indicated in FIG. 3, second hollow portion "B" is provided with longitudinally spaced apertures 46 which are indexable with apertures 32 formed in the outer side wall 28 of bracket 24.

Carried within hollow portion "B", which is defined by the spaced apart rectangular sheets 40 and 42, is pad means for padding the planar member 36 and bracket 24 when second hollow portion "B" is folded thereover in the manner shown in FIGS. 1 and 2.

Also forming a part of the safety hinge assembly of the present invention is a pair of transversely spaced connector pins 50 which are closely receivable through the apertures 38 provided in planar member 36, through the apertures provided in first portion "A" of the enclosure means, through the apertures 32 provided in the inner side walls 26 of the bracket 24 and finally through the apertures 46 provided in second portion "B" of the enclosure means when the latter means is in the folded over configuration shown in FIG. 2. To hold the enclosure means in the folded configuration, cap means, here provided in the form of smooth rounded caps 54, are receivable over the outside end 56 of the connector pins 50. Caps 54 include a flange 58 which engages the second hollow portion of the enclosure means to urge portion "B" of the enclosure means into pressural engagement with outside wall 28 of the bracket 24.

As best seen in FIG. 2, the opposite extremities of pins 50 include enlarged diameter heads 60 adapted to engage the inner walls of planar member 36. With this unique construction, the first portion of the enclosure means "A" is firmly held in position intermediate planar member 36 and inner wall 26 of bracket 24. Second portion "B" of the enclosure means can then be folded over the head 60 of pivot pin 50, over the upper margin **36*a* of planar member 36, around the bight portion 30 of bracket 24 and finally downwardly over the outer side wall 28 of the bracket 24**.

When the safety hinge is fully assembled in the manner shown in FIG. 2, the padding means, here provided in the form of a deformable resistant foam material 62, effectively pads the inner extremity 60 of the pivot pins, the planar member 36, the bracket 24 and the upper extremity of the legs 14 which are pivotally received within the bracket 24. with this novel safety construction, an infant placed within the interior of the playyard cannot be injured by, or obtain access to, the operating components of the hinge assembly. Rather, the infant can only contact with the safety padded second portion "B" of the enclosure means which functions to fully encapsulate the rigid working component parts of the hinge mechanism. Accordingly, from the interior of the playyard no connector pins, rivet heads or other fasteners are accessible to the infant. Further, should the infant fall against the hinge assembly, contact will be made only with the safety padded portion "B" of the safety enclosure.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In a foldable infant playyard of the character having angularly downwardly depending supporting legs pivotally movable from a first operating position wherein the lower extremities of the legs are spaced apart to a second folded position wherein said lower extremities of said legs are moved into close proximity, the improvement comprising a safety hinge means for effecting pivotal movement of said legs including:

(a) an elongated rigid bracket having transversely spaced inner and outer side walls each provided with longitudinally spaced apertures therethrough, the upper extremities of said legs being closely receivable between said side walls of said bracket, said legs having apertures therethrough indexable with said apertures in said side walls of said bracket;

(b) an elongated planar member disposed proximate said inner side wall of said rigid bracket, said planar member having longitudinally spaced apertures indexable with said apertures in said inner side wall of said bracket;

(c) enclosure means for enclosing said planar member and said bracket, comprising:

(i) a first portion receivable between said planar member and said inner side wall of said bracket, said first portion having longitudinally spaced apertures indexable with said apertures in said planar member;

(ii) a second hollow portion connected to said first portion, said second hollow portion having an edge portion provided with longitudinally spaced apertures indexable with said apertures in said outer side wall of said bracket;

(iii) pad means carried within said second hollow portion for padding said planar member and said bracket when said second hollow portion is folded thereover;

(d) a pair of connector pins having first and second extremities, said connector pins being closely receivable through said apertures provided in said planar member, said first portion of said enclosure means, said inner side wall of said bracket, said legs, said outer side wall of said bracket and said second hollow portion of said enclosure means, said first extremities of said connector pins being disposed intermediate said planar member and said enclosure means when said latter means is folded over said planar member; and (e) cap means receivable over said second extremities of said connector pins for engagement with said enclosure means for holding said enclosure means in position enclosing said planar member and said bracket.

2. A safety hinge means as defined in claim 1 in which said elongated rigid bracket is generally "U" shaped in cross-section having a bight portion interconnecting said side walls and in which said bight portion of said bracket overlays the upper extremities of the supporting legs of the infant playyard.

3. A safety hinge means as defined in claim 1 in which said enclosure means comprises a pair of substantially rectangularly shaped thin sheets of flexible material having aligned outer margins said sheets being connected together along the outer margins thereof.

4. A safety hinge means as defined in claim 3 in which said pad means comprises a yieldably resilient plastic foam material interposed between said thin sheets of flexible material.

5. A protective covering for covering a hinge mechanism of the character embodied in infant furniture and having a pivot plate provided with an aperture therethrough, a pivot pin removably receivable within said aperture, a head affixed to one end of said pivot pin and a pivotally movable member having an aperture therethrough for receiving said pivot pin, said protective covering means comprising:

(a) a first portion receivable between said head of said pivot pin and said pivot plate, said first portion having an aperture therethrough indexable with said aperture in said pivot plate;

(b) a second hollow portion connected to said first portion said second hollow portion being foldable over said first portion, said pivot plate and said pivotally movable member and having an edge portion provided with an aperture therethrough indexable with said apertures in said pivot plate and said pivotally movable member when said second hollow portion is folded over said pivot plate and said pivotally movable member;

(c) pad means carried within said second hollow portion for padding said pivot plate and said pivotally movable member when said second hollow portion is folded thereover; and (d) cap means connectable with said other end of said pivot pin for engagement with said second hollow portion for holding said hollow portion in a folded position.

6. A protective covering as defined in claim 5 including a planar member having an aperture therethrough indexable with said aperture in said pivot plate, said planar member being disposed intermediate said head of said pivot pin and said first portion of said protective covering means.

* * * * *